US006157775A

United States Patent [19]

Tsai

[11] Patent Number: 6,157,775

[45] Date of Patent: Dec. 5, 2000

[54] MULTI-FUNCTIONAL ELECTRIC HEATING VAPOR CLEANING DEVICE

[76] Inventor: Sam Tsai, 4F, No. 14, Lane 281, Sec. 2, His Yuan Road, Taipei, Taiwan

[21] Appl. No.: 09/221,651

[22] Filed: Dec. 23, 1998

[51] Int. Cl.[7] ..... A61H 33/12; A47L 7/00

[52] U.S. Cl. ..... 392/404; 15/320

[58] Field of Search ..... 392/386, 390, 392/394, 395, 403, 404, 405, 406; 15/320, 321, 322; 68/222, 5 R

[56] References Cited

U.S. PATENT DOCUMENTS

| | | | |
|---|---|---|---|
| 2,385,865 | 10/1945 | Kollmeyer | 15/176.2 |
| 3,675,449 | 7/1972 | Bluestein | 68/222 |
| 3,811,208 | 5/1974 | Vieceli et al. | 68/222 |
| 4,206,340 | 6/1980 | Osrow et al. | 392/334 |
| 5,447,597 | 9/1995 | Zimmermann et al. | 392/404 |
| 5,602,958 | 2/1997 | Vergnes | 392/395 |
| 6,031,969 | 2/2000 | Burr et al. | 392/404 |

*Primary Examiner*—Sang Paik

*Attorney, Agent, or Firm*—Ostrolenk, Faber, Gerb & Soffen, LLP

[57] ABSTRACT

A multi-functional electric heating vapor cleaning device comprises an upper case, a lower case, a vapor generating structure, and a power supplying structure. The water box is located within the space formed by the upper case and the lower case. The power lines is connected with and extended from the box cover and pulled out from an outlet to be connected with a plug, next, the upper case and the lower case are screwed together. Therefore, the multi-functional electric heating vapor cleaning device is constructed. The cleaning device can be combined with a flat brush, or a scraping device, or a tapered brush so as to clean various objects and meanwhile inject vapor to the object. Thereby, by the multi-functional electric heating vapor cleaning device of the present invention, the heat is generated by evaporating, thus heat loss is low and the strength of vapor is very steady. Further, it is easily controlled.

6 Claims, 8 Drawing Sheets

MULTI-FUNCTIONAL ELECTRIC HEATING VAPOR CLEANING DEVICE

FIELD OF THE INVENTION

The present invention related to a multi-functional electric heating vapor cleaning device, especially to a vapor cleaning device wherein, the heat is generated by evaporating, whereby heat loss is low and the strength of a vapor is very steady and is easily controlled.

BACKGROUND OF THE INVENTION

A currently used similar product to the present invention is a vapor iron for pressing clothes. The defect of the vapor iron is that the steam is generated by boiling, the heating loss is high and variation of heat generation is large. Also, the speed of air flow is difficult to control. Another design is a glass scraping device, which is difficult to be manufactured and only has unique function. In summary the prior art has the following disadvantages:

1. The vapor is generated by boiling, thus the heat loss is high, and the variation of the strength of vapor flow is dramatic so that the vapor can not be well controlled.
2. The heat generating means is made by compression casting, whereby some defects, such as cracks and hole size reduction are easily formed.
3. A temperature controlled relay and thermal fuse are used as a safety design. Thus, the cost thereof is high and water is easily drained out.
4. If it is desired to increase the water storage, this must induce that the water is easy to drain out and the assembly process is very complicated.
5. The assembly process is very complicated and the manufacturing process is long, thus it is difficult to be manufactured by an automatic process.

SUMMARY OF THE INVENTION

Therefore, the primary object of the present invention is to provide a multi-functional electric heating vapor cleaning device, wherein the heat is generated by evaporating, thus heat loss is low and the strength of vapor is very steady and is easily controlled.

Accordingly, in order to achieve the aforementioned object, the present invention provides a multi-functional electric heating vapor cleaning device comprising an upper case, a lower case, a vapor generating structure, and a power supplying structure. The water box is located within the space formed by the upper case and the lower case. The power line is connected with and extends from the box cover and is connected with a plug. Then, the upper case and the lower case are screwed together. Therefore, the multi-functional electric heating vapor cleaning device is constructed. The cleaning device can be combined with a flat brush, or a scraping device, or a tapered brush so as to clean various objects and meanwhile inject vapor to the object. Thereby, by the multi-functional electric heating vapor cleaning device of the present invention, the heat is generated by evaporating, thus heat loss is low and the strength of vapor is very steady and is easily controlled.

The various objects and advantages of the present invention will be more readily understood from the following detailed description when read in conjunction with the appended drawing.

DETAILED DESCRIPTION OF THE PREFERRED EMBODIMENTS

Figure 1:
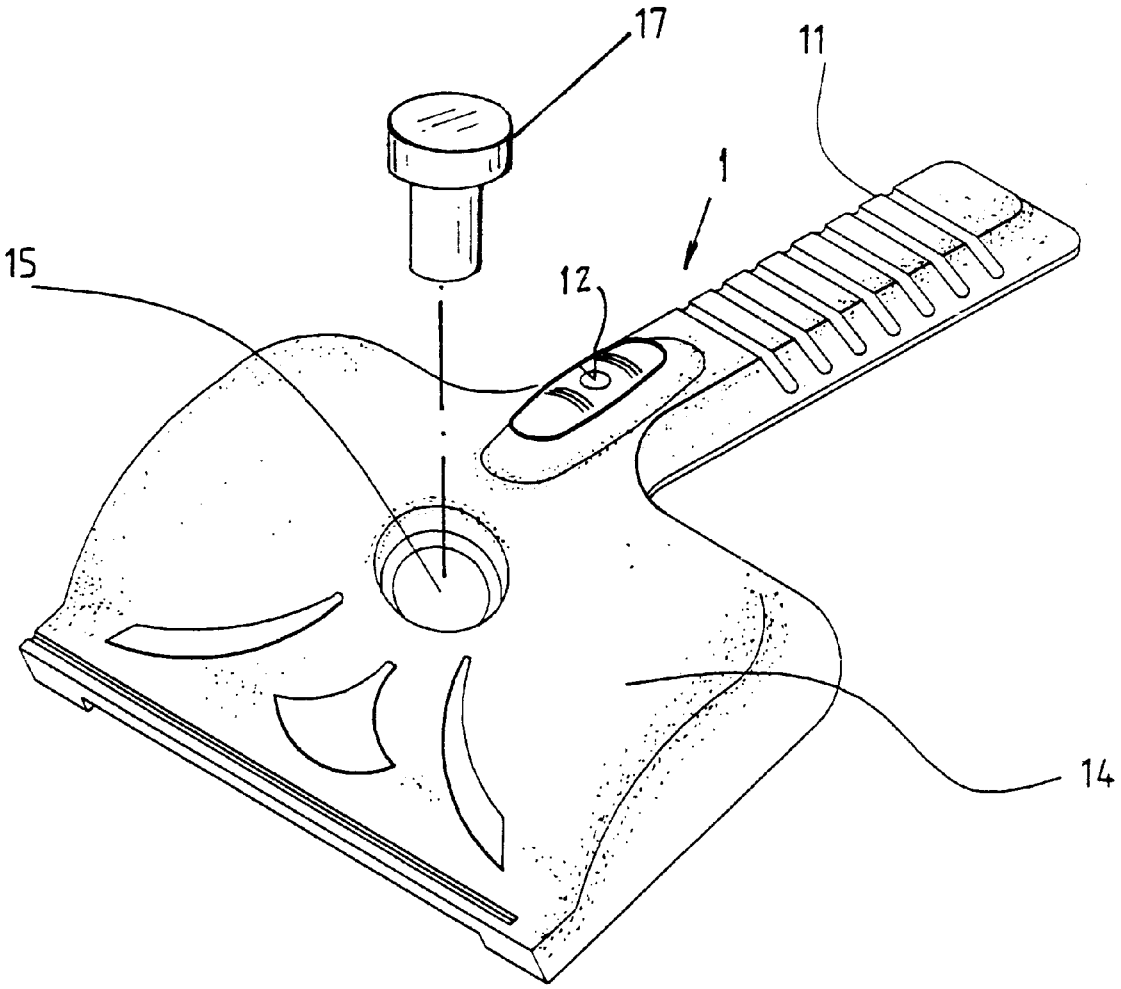
FIG. 1 is a schematic perspective view of the upper case of the present invention.
Figure 2:
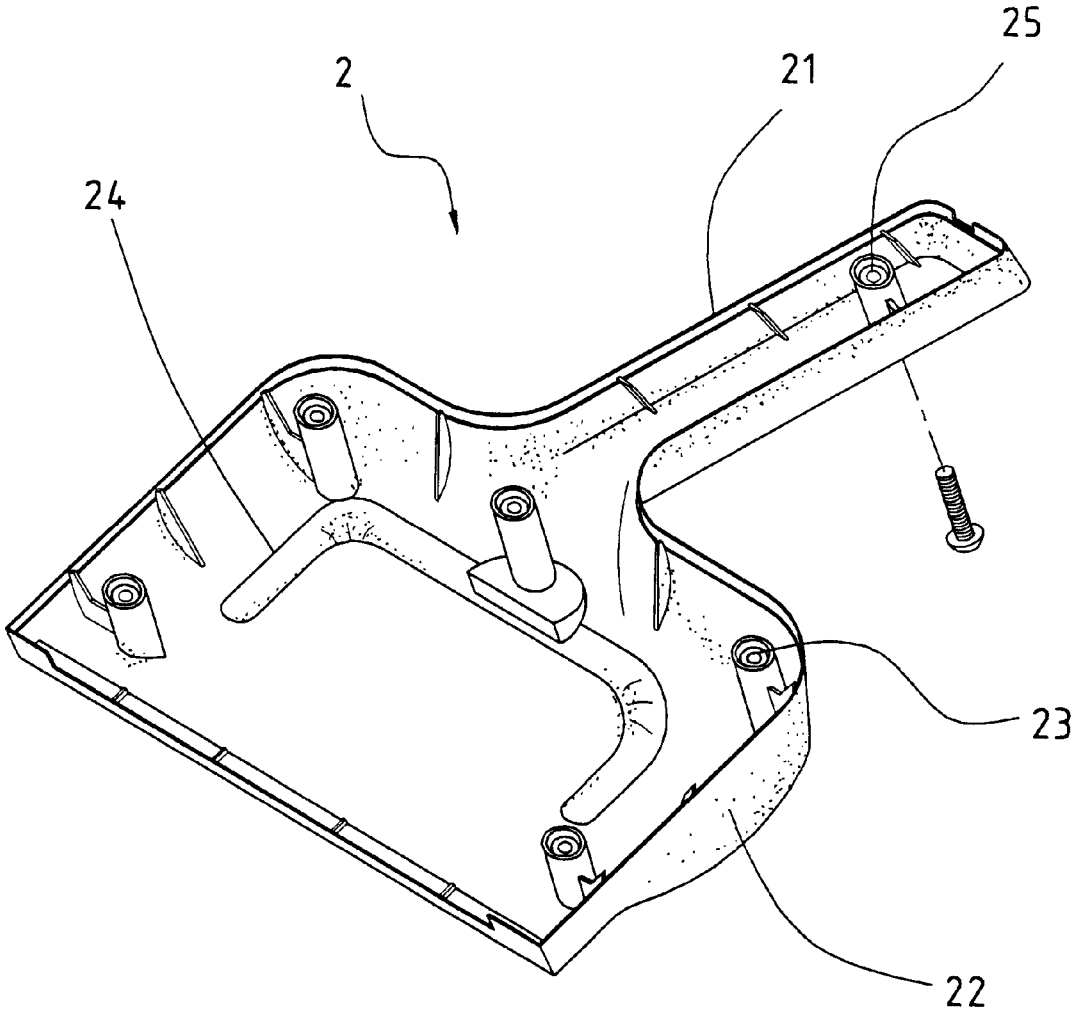
FIG. 2 is a schematic perspective view of the lower case of the present invention.
Figure 3:
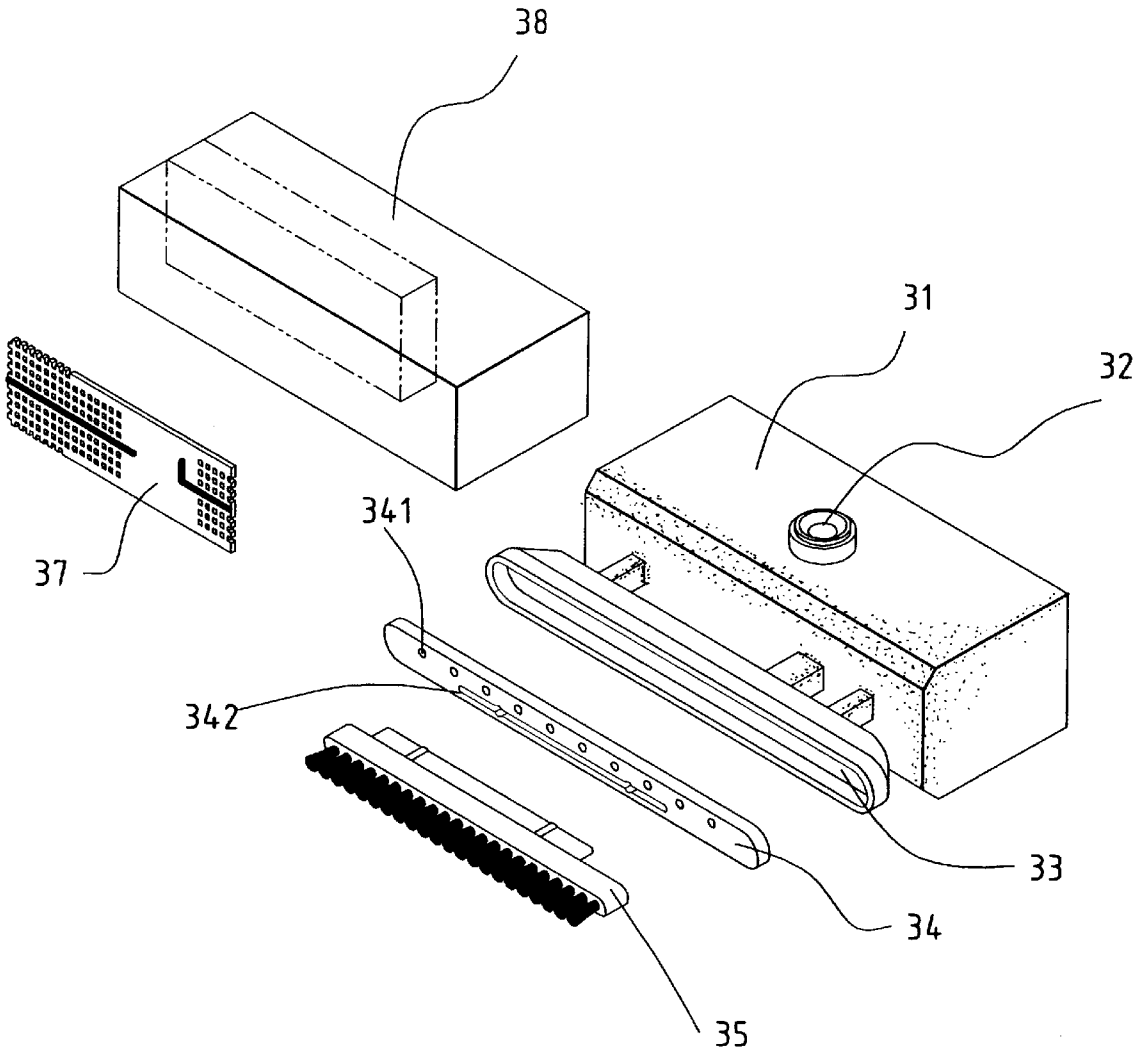
FIG. 3 is a schematic perspective exploded view of the water box of the present invention.
Figure 4:
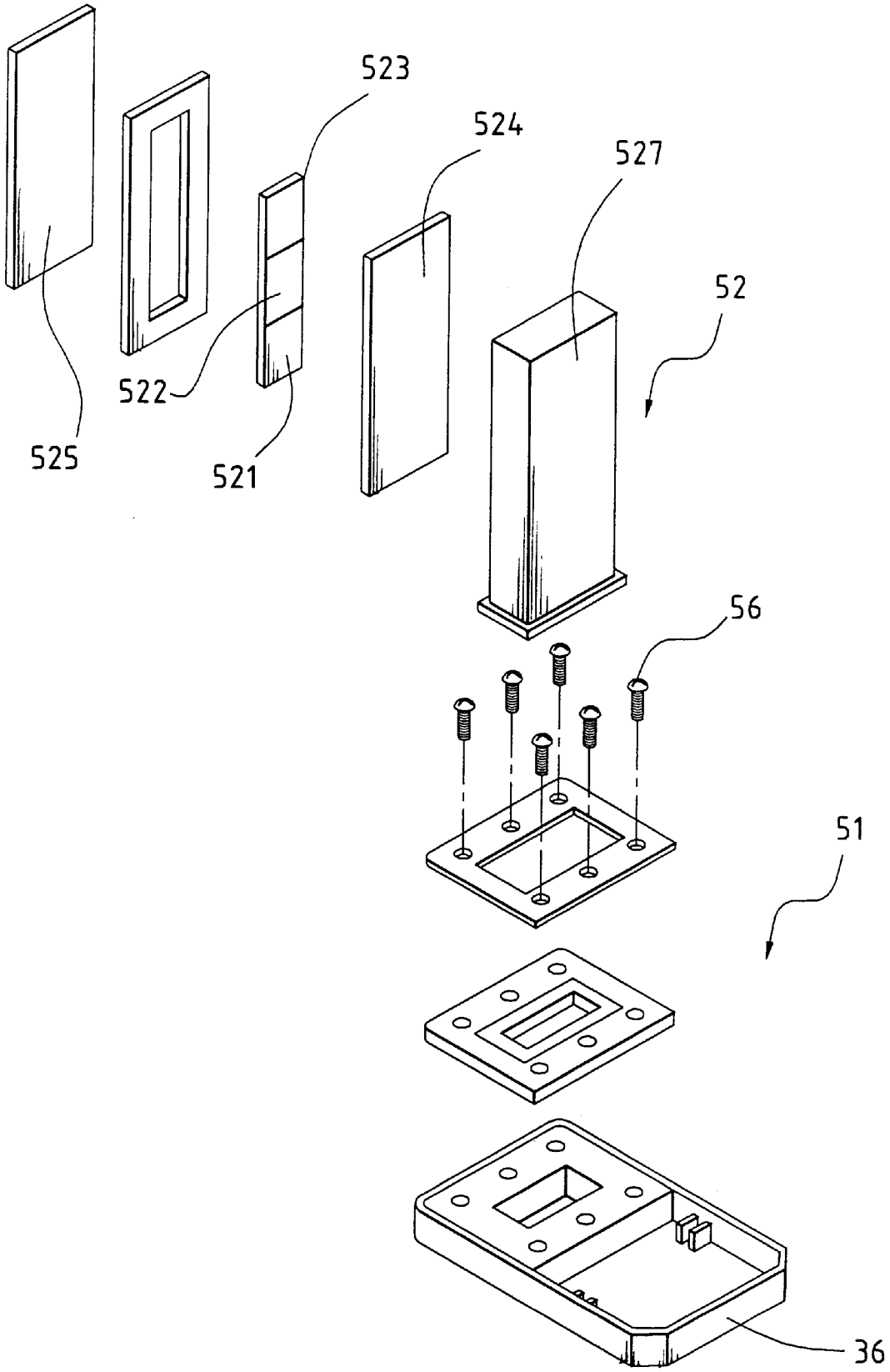
FIG. 4 is a schematic exploded view of the power supplying device of the present invention.
Figure 5:
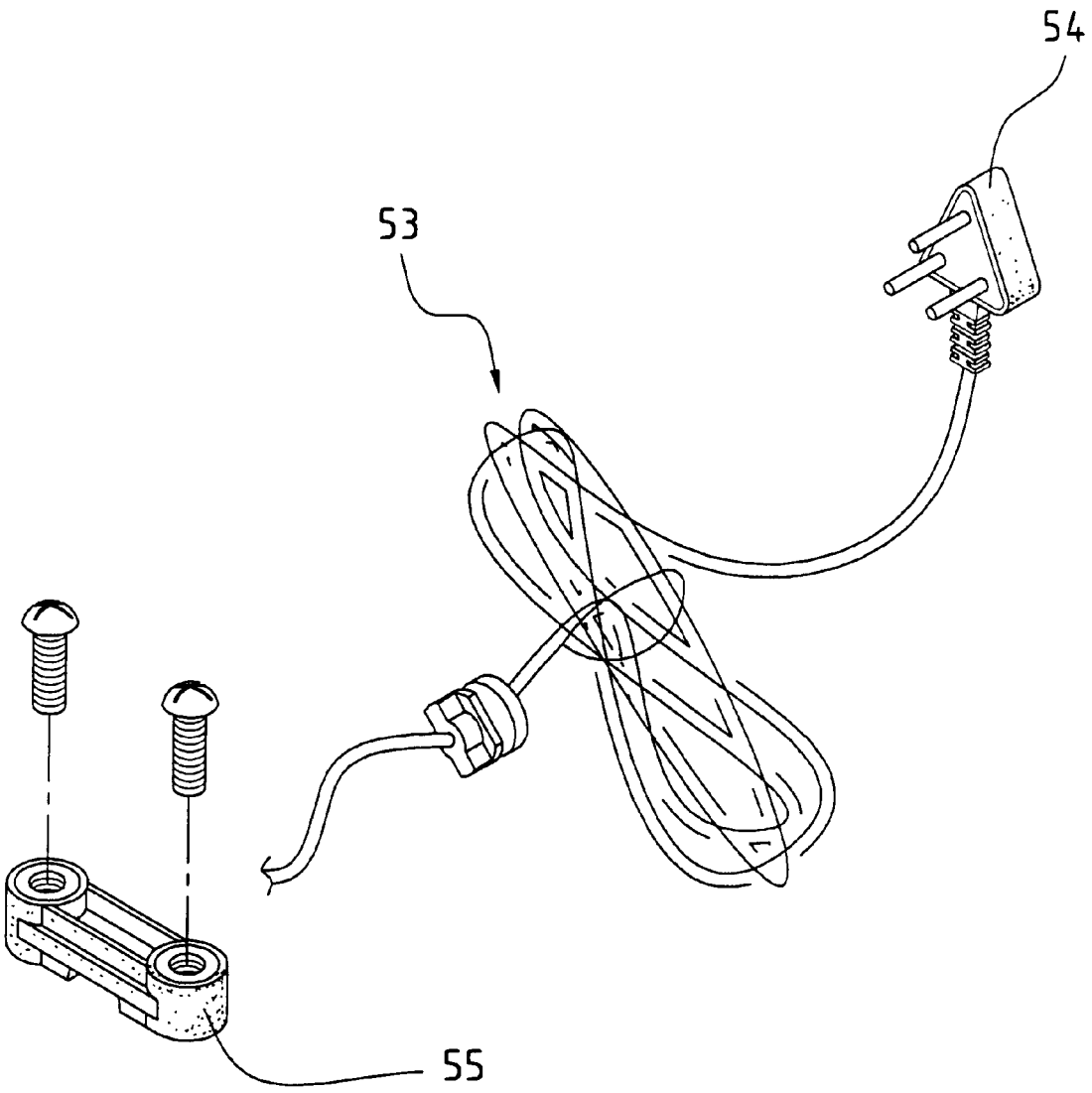
FIG. 5 shows a schematic view of the power line of the present invention.

With reference now to FIGS. 1–5, a vapor gun of the present invention includes an upper case 1, a lower case 2, a vapor generating structure 3 and a power supply device 5. The upper case 1 is formed with an upper handle 11, a switch 12 on the handle, and an upper cover 14 formed with the handle a water input hole 15 in the center of the cover 14. In general, the vapor input hole 15 is closed by a screw 17. The lower case 2 is formed with a lower handle 21, a lower cover 22, a fixing strip 24 inside the lower cover, and five screw holes 23 and a screw hole 25 for attachment of the upper cover. The upper and lower covers define a space for the vapor generating structure 3, which primarily includes a water box 31 with a water inlet 32 on the center of the upper surface thereof, a vapor nozzle 33, a nozzle cover 34, and a flat brush 35.

Further on the side of the water box is a water box cover 36. A spacer 37 is adhered to the box cover 36, two cotton blocks 38 for absorbing water being adhered on the two sides of the spacer 37, and the water inlet 32 is aligned with the water input hole 15 in the upper case 1. The nozzle cover 34 has a plurality of vapor outlet holes 341 and a groove 342. The flat brush 35 has a fixing piece at the lower side so as to be inserted into the groove 342. After assembly, the water inlet 32 of the water box 31 communicates with the water input hole 15 and can be engaged tightly so that the water will not drain out from the hole 15.

Moreover, the power supplying structure 5 is comprised of a fixing structure 51, an heating generating piece 52 fixed on the box cover 36 by the fixing structure 51 for being held in the water box 31, and a pair of power lines 53. One of the ends of the power lines 53 are connected to the heating generating piece 52, then passes through the switch 12 and finally extends to the outside of the vapor gun and is connected with a plug 54. The vapor input hole 15 and water inlet 32 are tightly screwed by the screw 17. If it is desired to fill water into the water, the screw 17 is opened, thus the water is filled from the hole 15.

Figure 6:
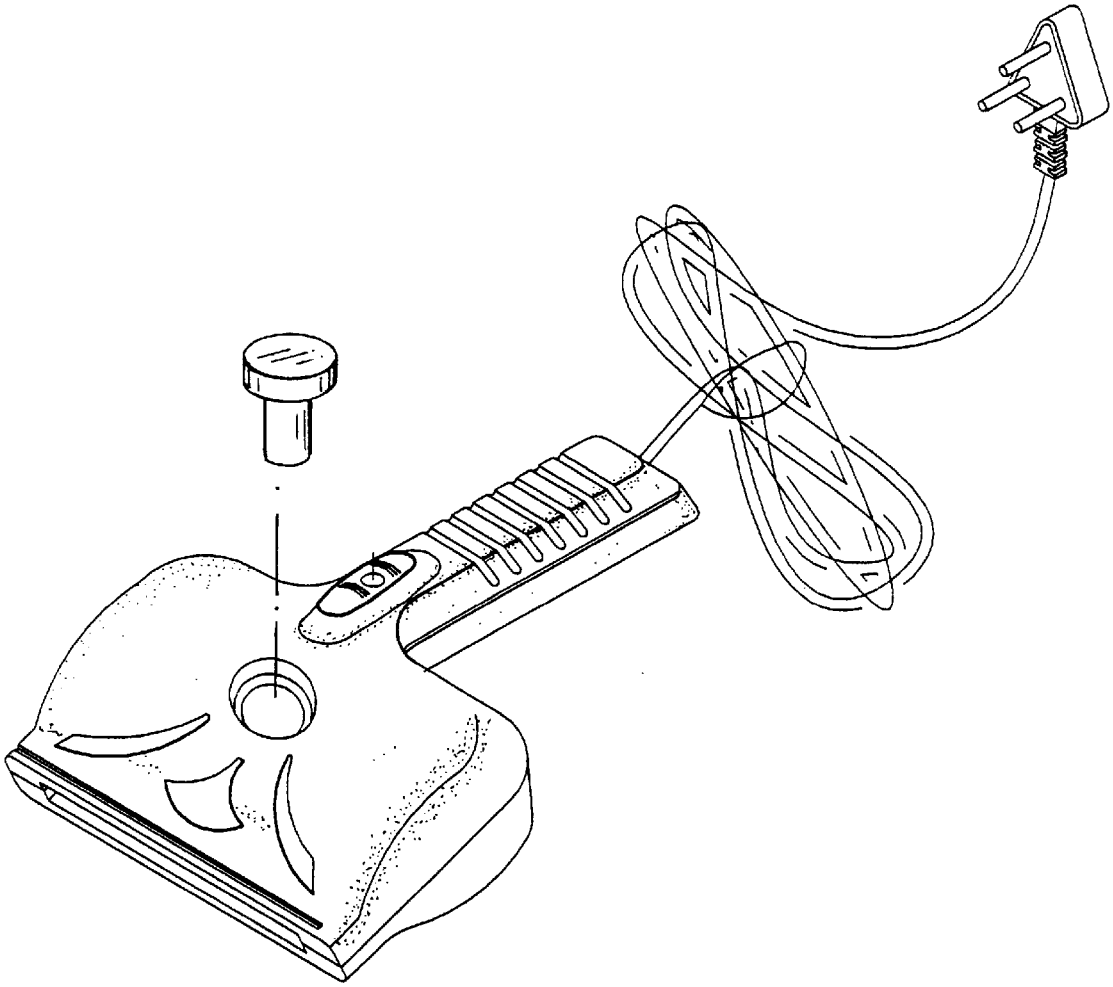
FIG. 6 is an assembled perspective view of the present invention.

In assembly, the heating generating piece 52 is attached on the box cover 36 and in the box 31 through the fixing means 51 with the spacer 37, then the assembled structure are enclosed by a cotton block 38. Next, the assembled box cover 36 is inserted into the water box 3 and tightly fitted with the water box 3. Next, the water box 3 is located within the space formed by the upper case 1 and the lower case 2. While the power lines 53 extending from the box cover 36 firstly pass through the switch 12 and finally are pulled out from an outlet (not shown) to be connected with a plug 54. Next, the upper case 1 and the lower case 2 are screwed together through the screw holes on the upper and lower cases by screws. A screw 17 is used to screw the opening 15. Therefore, multi-functional electric heating vapor cleaning device is assembled as shown in FIG. 6.

In using, the screw 17 is released and water is filled through the opening 15 to the water box 31 and is absorbed within the cotton block 38. By this design the free flow of water is prevented and further the amount of stored water is increased. The heat generating piece 52 is formed by clamping three PTC resistors 521, 522 and 523 by two aluminum electrode plates 524, 525, using a mica frame 526 to confine the structure. Then, power lines 53 are connected with respective aluminum electrode plates 524, 525. Next, an insulating paper encloses the assembled structure. Finally, the whole structure is placed into an aluminum box 527. The PTC resistor can be cut off when the temperature is above 150 degrees. By this design, the vapor is generated through evaporating, thus the vapor flow is steady and is easily controlled. Therefore, the temperature controlled relay and thermal fuse are unnecessary. Also, the reliability is further improved.

Figure 7:
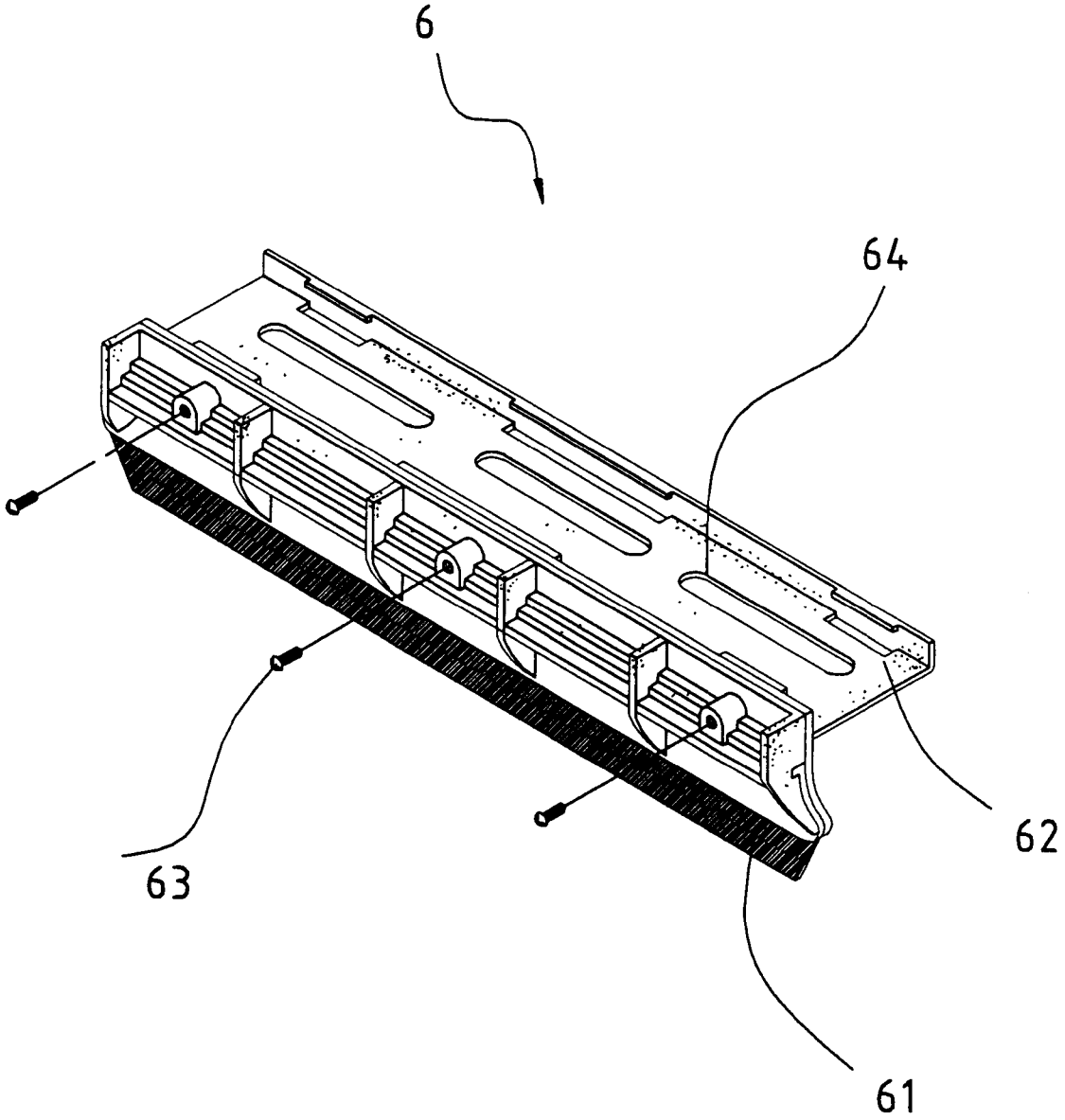
FIG. 7 is the perspective view of the scraping device in another embodiment of the present invention.

As shown in FIG. 7, another embodiment of the present invention is illustrated. The flat brush 35 of the present invention can be replaced by a scraping means 6 formed by a scraping piece 61, and a fixing base 62. The fixing base 62 is formed in an L shape. The size of one side of the base is suitable to be mounted to the nozzle cover 34 of the vapor gun so that it can be buckled therewith, while a plurality of openings 64 are formed thereon. The scraping piece 61 is clamped by the another side of the fixing base 62 and then screws 63 are used to screw the scraping piece 61 and the fixing base 62 together. In using, the scraping means 6 is buckled to the nozzle 33 of the vapor gun. Therefore, the vapor gun serves as a scraping device to scrape dust of particles from, for example, glass and meanwhile vapor flow out from the nozzle 33 through the openings to the glass.

Figure 8:
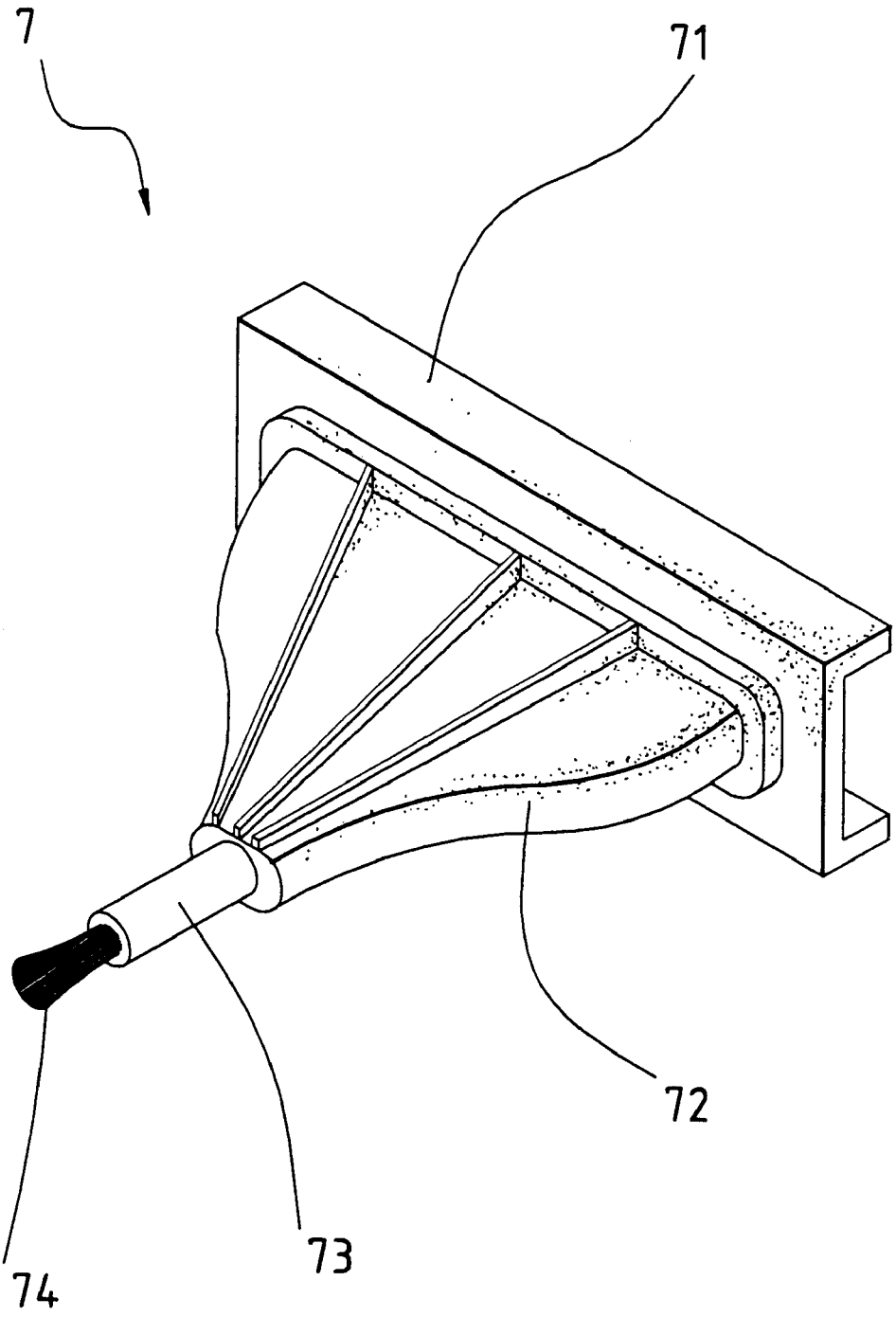
FIG. 8 is the perspective view of the tapered brush in the other embodiment of the present invention.

In a further embodiment of the present invention, the flat brush 35 can be replaced with a tapered brush 7 as shown in FIG. 8. The tapers brush is formed by a seat 71, a tapers tube 72, a tube 73 and a brush 74. The size of the seat 71 is suitable to buckle with the nozzle cover 34. In use, the tapered brush 7 is buckled with the nozzle cover 34. As power is turned on, the vapor injects out from the tube 73, whereby the cleaning device of the present invention serves to clean a narrow portion.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-functional electric heating vapor cleaning device comprising:

an upper case formed by an upper handle, a power switch, and an upper cover with a water input hole therein, the water inlet hole being covered and openable;

a lower case formed by a lower handle, a lower cover, and the lower case is attached to the upper case;

a vapor generating structure comprising a water box having an upper surface with a water inlet in the upper surface thereof, a vapor nozzle, a nozzle cover, a box cover on the side of the water box, a spacer adhered to the box cover, a water absorbing block for absorbing water adhered on the two sides of the spacer, the nozzle cover having a plurality of vapor outlet holes and having a groove, wherein after assembly of the device, the water inlet of the water box and the water input hole of the upper case communicate with each other and can be engaged tightly so that the water will not drain out from the water input hole; and a power supplying structure comprising a fixing structure, a heat generating piece fixed on the box cover by another fixing structure, and a pair of power lines having one ends connected to the heating generating piece, then the linespassing through the switch and extending to the outside of the vapor gun and being there connected with a plug.

2. The multi-functional electric heating vapor cleaning device according to claim 1, wherein the heat generating piece is adhered on the fixing structure, the box cover with the spacer are enclosed by a water absorbing block, the box cover is inserted into the water box and tightly fitted with the water box, the water box is located within the space formed by the upper case and the lower case, the power lines are connected with and extend from the box cover, and extend out from an outlet to be connected with the plug, the upper case and the lower case are locked together and the water input hole is sealed.

3. The multi-functional electric heating vapor cleaning device according to claim 1, wherein the heat generating piece includes three PTC resistors, two aluminum electrode plates, a mica frame, an insulating paper, and an aluminum box, wherein:

the three PTC resistors are clamped by the two aluminum electrode plates;

the mica frame confines the structure;

the insulating paper encloses the assembled structure; and the aluminum box contains the whole structure;

wherein the PTC resistor is adapted to cut off as the temperature is above 150 degrees.

4. The multi-functional electric heating vapor cleaning device according to claim 1, further comprising a flat brush with a fixing piece the nozzle cover having a groove and the flat brush is inserted into the groove of the nozzle cover so that the multi-functional electric heating vapor cleaning device is used to brush some object, while vapor may flow out from the vapor outlet hole.

5. The multi-functional electric heating vapor cleaning device according to claim 1, further comprising scraping means including a scraping piece, and a fixing base, wherein the fixing base is formed in an L shape, the size of one side of the L-shape base is for the L shape base to be mounted to the nozzle cover of the vapor gun so that it can be buckled therewith, a plurality of openings are formed therein, the scraping piece is clamped by the other side of the fixing base, wherein in using, the scraping means is buckled with the nozzle of the vapor gun, whereby the vapor gun serves as a scraping device which outputs vapor.

6. The multi-functional electric heating vapor cleaning device according to claim 1, further comprising a tapered brush including a seat, a tapered tube, a tube and a brush, wherein the size of the seat is suitable to buckle the brush with the nozzle cover, whereby as power is turned on, the vapor flows out from the tube, enabling the cleaning device to clean a narrow portion.

* * * * *